US007059187B2

(12) United States Patent
Clarke, III et al.

(10) Patent No.: US 7,059,187 B2
(45) Date of Patent: Jun. 13, 2006

(54) SEAMLESS PRESSURE VESSEL

(75) Inventors: John Clarke, III, Akron, OH (US); Ronald Eureka, Mantua, OH (US)

(73) Assignee: Tempo Products Co., Inc., Solon, OH (US)

( * ) Notice: Subject to any disclaimer, the term of this patent is extended or adjusted under 35 U.S.C. 154(b) by 303 days.

(21) Appl. No.: 09/758,026

(22) Filed: Jan. 10, 2001
(Under 37 CFR 1.47)

(65) Prior Publication Data

US 2002/0053366 A1 May 9, 2002

Related U.S. Application Data

(60) Provisional application No. 60/175,364, filed on Jan. 10, 2000.

(51) Int. Cl.
*G01F 23/30* (2006.01)

(52) U.S. Cl. ..... 73/305; 73/320; 264/503; 264/516; 220/562; 220/581; 220/582; 220/583; 220/600; 220/601; 220/86.1; 220/86.2

(58) Field of Classification Search ..... 73/305, 73/320; 264/503, 516; 220/562, 581, 582, 220/583, 600, 601, 86.1, 86.2
See application file for complete search history.

(56) References Cited

U.S. PATENT DOCUMENTS

| | | | | | |
|---|---|---|---|---|---|
| 3,780,582 | A | * | 12/1973 | Ajero | 73/320 |
| 4,617,879 | A | * | 10/1986 | Mori | 123/73 AD |
| 4,781,314 | A | * | 11/1988 | Schoonover et al. | 222/465.1 |
| 4,807,472 | A | * | 2/1989 | Brown et al. | 73/313 |
| 4,991,436 | A | * | 2/1991 | Roling | 73/320 |
| 5,199,570 | A | * | 4/1993 | McKenzie | 206/503 |
| 5,415,316 | A | * | 5/1995 | Pemberton et al. | 220/562 |
| 6,138,853 | A | * | 10/2000 | Frechette | 220/212.5 |
| 6,193,924 | B1 | | 2/2001 | Huse | |

* cited by examiner

*Primary Examiner*—Hezron Williams
*Assistant Examiner*—André K. Jackson
(74) *Attorney, Agent, or Firm*—Calfee Halter & Griswold, LLP

(57) ABSTRACT

A seamless marine fuel tank having directly mechanically fastened component parts such as a fuel withdrawal assembly and a direct-sight fuel gauge system. The fuel withdrawal system contains a split-nut fastening device which fastens the system to the tank and allows for 360 rotation of fuel withdrawal outlet. The direct-sight gauge contains a threaded gauge neck with a cradle and tabs in its interior wall into which a one-piece float arm is snapped.

10 Claims, 24 Drawing Sheets

SEAMLESS PRESSURE VESSEL

This application claims the benefit of U.S. provisional patent application No. 60/175,364 filed on Jan. 10, 2000, the entirety of which is hereby incorporated by reference.

FIELD OF THE INVENTION

The present invention relates to pressure vessels or other vessels designed to be gas or liquid-tight. This invention relates particularly to portable fuel tanks, and more particularly to fuel tanks used in marine fuel systems.

BACKGROUND OF THE INVENTION

A typical marine fuel tank is designed to be versatile and adaptable. The tank should be capable of easy use in a multitude of watercraft and with a multitude of engines. It should be able to maintain its functionality in a broad range of temperature, weather and storage conditions. The tank should also be able to survive the hazards of transport, either as cargo or in operation on a watercraft. To be competitive in the field of marine fuel tanks, manufacturers desire to be able to produce a tank that meets these requirements and more, and do so in a cost effective manner.

Marine fuel tanks carry flammable and environmentally hazardous liquids. For reasons of safety, ecology and economy, it is especially important that these tanks be leak-free. Improvements in methods of tank manufacture have resulted in single body tank shells that are free of seams or connective interfaces where leaks are most likely to occur. But this single body construction has not reduced the potential for leakage at the interface of the tank shell and the components that are attached to its outer surface. Material creep and component separation are frequently responsible for leaks occurring at the interface of the tank shell and its components. The device of the present application improves the seal between the tank and its components, thereby reducing the potential for leakage at the tank shell/component interfaces caused by material creep or other factors.

At its most basic, a marine fuel system is comprised of an engine connected to a fuel tank via a fuel line. Efficient delivery of fuel from the tank to the engine is at least partially dependent on the condition of the fuel line. The fuel line should be leak free, air tight, and free of kinks which impede the flow of fuel. Kinking can also cause breaks in the fuel line. Typically, the fuel line attaches to the tank at the tank's fuel withdrawal assembly, a component which is partially located on the tank's outer surface, and which also extends into the interior of the tank. The potential for kinking increases as the path the fuel line takes from the tank to the engine deviates from perfect linearity. Therefore, the orientation of the fuel withdrawal outlet in relation to the engine partially determines the amount of kinking force to which the fuel line will be subjected. This orientation also determines how much force the fuel line will reciprocally exert on the fuel withdrawal outlet itself, a potential breakage point. Ideally then, the path from the fuel tank to the engine should be linear. Unfortunately, fuel tanks occupy different locations in different watercraft, and sometimes tanks are moved to multiple locations within a single watercraft. Thus there is no fixed fuel withdrawal outlet position which guarantees a linear fuel withdrawal outlet/engine relationship.

Moreover, the fact that part of the fuel withdrawal is located on the outer surface of the tank means that the withdrawal will occasionally be subject to forces which may shear it from the tank. It is desirable that the fuel withdrawal be able to withstand the shearing forces that it will likely experience in normal conditions of transport and operation (dropping, shifting, bumping, falling or dropped objects, etc.).

SUMMARY OF THE INVENTION

The present invention provides a marine fuel tank with a fuel withdrawal assembly designed to reduce the likelihood of shearing and also provides a fuel tank requiring fewer components necessary to secure the tank's components to the tank shell. The reduction in components results in a reduction in the potential for component failure and an overall reduction in the cost of producing the present marine fuel tank. Specifically, the present invention provides for a marine fuel tank whose external components are mechanically fastened directly to the tank shell. The tank shell, preferably formed from high-density polyethylene (HDPE), is molded with threaded bosses that accommodate component pieces with complementary threads. The component pieces become mechanically fastened directly to the tank shell as they are screwed into or onto the threaded portion of the tank shell. The direct mechanical fastening of the component to the tank shell reduces the effects of material creep on the tank shell, thereby reducing the risk of leakage at the tank shell/component interface. Moreover, mechanically fastening the component directly to the tank shell reduces the need to chemically bond or hotplate weld the component or components to the tank shell in order to complete the assembly of the tank.

This invention provides a marine fuel tank with a fuel withdrawal outlet capable of 360° rotation, so that a linear relationship may be maintained between the fuel withdrawal outlet and the engine, regardless of the position of the tank and the engine in relation to each other. Specifically, the present invention further provides a marine fuel tank whose fuel withdrawal assembly is mechanically fastened directly to the tank shell via interlocking threads, and yet provides for a fuel withdrawal outlet capable of rotating 360 degrees so that a linear relationship may be maintained between the outlet and the watercraft's engine. This is accomplished through the split-nut design of the fuel withdrawal assembly. The fuel withdrawal assembly is comprised in part of the withdrawal outlet piece and the split-nut housing which surrounds it. The withdrawal outlet piece is a hollow device designed to facilitate the flow of fuel from the tank to the engine. One end of the withdrawal outlet extends partially into the interior of the fuel tank and connects to a tube or hose which extends the remaining distance to the bottom of the tank. Just above the hose connection portion of the withdrawal piece is a flange extending around the circumference of the withdrawal piece. This washer-like flange forms a sealed interface between the tank shell and the fuel withdrawal when the withdrawal system is fastened to the tank shell. The split-nut portion of the fuel withdrawal system attaches to the withdrawal piece just above the flange, so that the bottom of the split-nut contacts the top of the flange. The split-nut is comprised of two rigid, substantially hollow pieces designed to surround and accommodate a portion of the withdrawal outlet piece, and which interlock to form a continuously threaded fastening device substantially surrounding the outlet piece. The outlet piece is able to rotate 360 degrees while secured within the interlocked halves of the split nut. The threaded fastening device is then mechanically fastened to the tank shell, with a portion of the withdrawal outlet piece extending outwardly from the tank shell to be connected to a fuel line.

The present invention further provides for an improved direct-sight fuel gauge system which is mechanically fastened directly to the fuel tank shell. The direct-sight gauge is comprised of a one-piece float arm/fuel level indicator which is connected to the gauge system via undercuts or cradles in the interior wall of the gauge neck. The gauge neck is a cylindrical component with two sets of threads. One set of threads allows the gauge neck to be mechanically fastened to the tank shell via complimentary threads on the tank shell. The other set of threads on the gauge neck are designed to accommodate and compliment the threaded gauge cap.

DETAILED DESCRIPTION OF THE INVENTION

The present invention comprises an improved fuel tank. Although this specification describes a marine fuel tank, the invention described and disclosed herein could be any fuel tank or other pressure vessel from which liquids or gases are extracted or expelled in a closed or airtight system. The present invention is a marine fuel tank having a seamless tank shell to which component parts such as a fuel withdrawal or direct-sight fuel gauge can be mechanically fastened. For the purpose of this invention, "mechanically fastened" shall mean that the component parts are secured to the tank shell only by the mechanical interaction of the components to the tank shell, and without the benefit of welding, chemical bonding, adhesives or additional mechanical fasteners such as screws.

Figure 1:
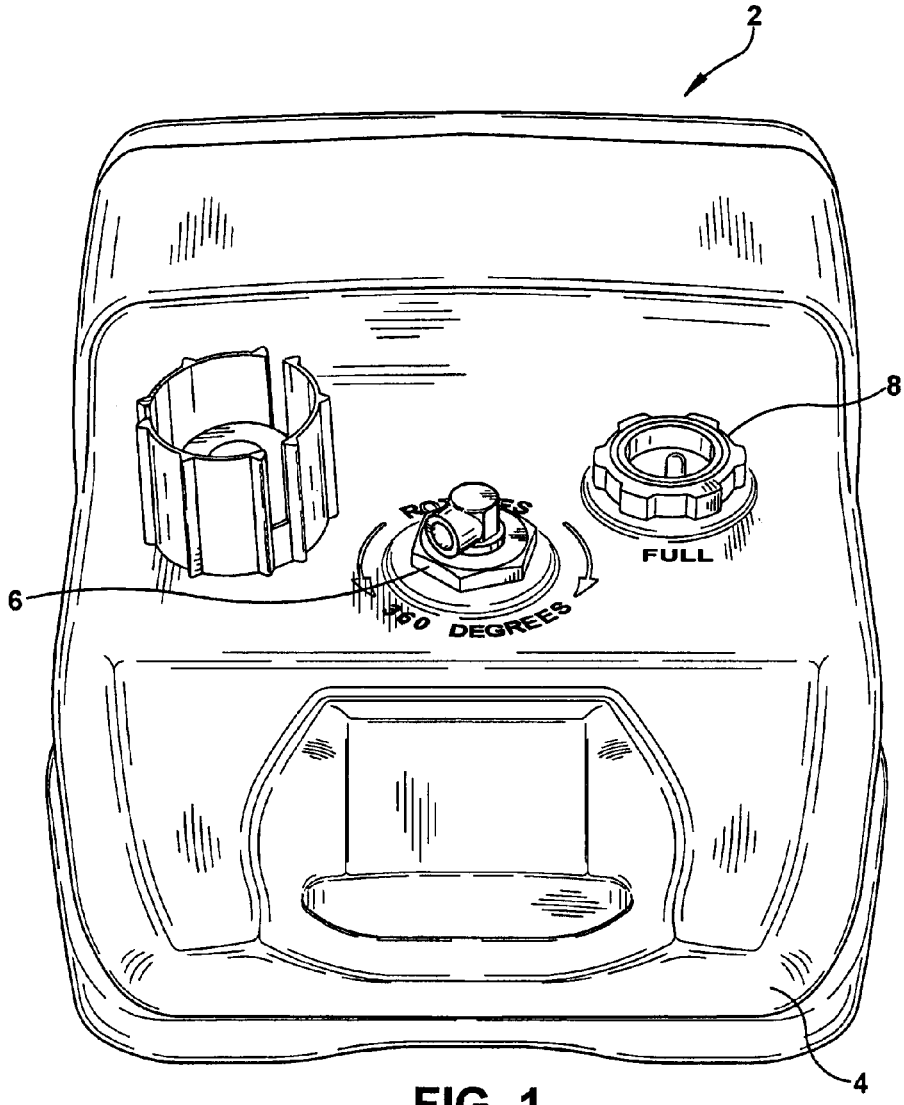
FIG. 1 is a perspective view of the fuel tank of the present invention demonstrating a fuel withdrawal assembly and a direct-sight fuel gauge system mechanically fastened to the tank shell.
Figure 1A:
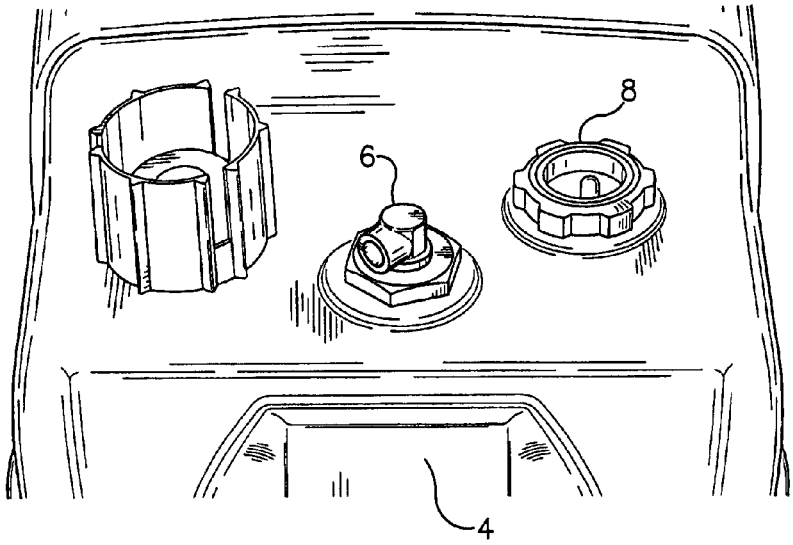
FIG. 1A is a close-up view of FIG. 1.
Figure 1B:
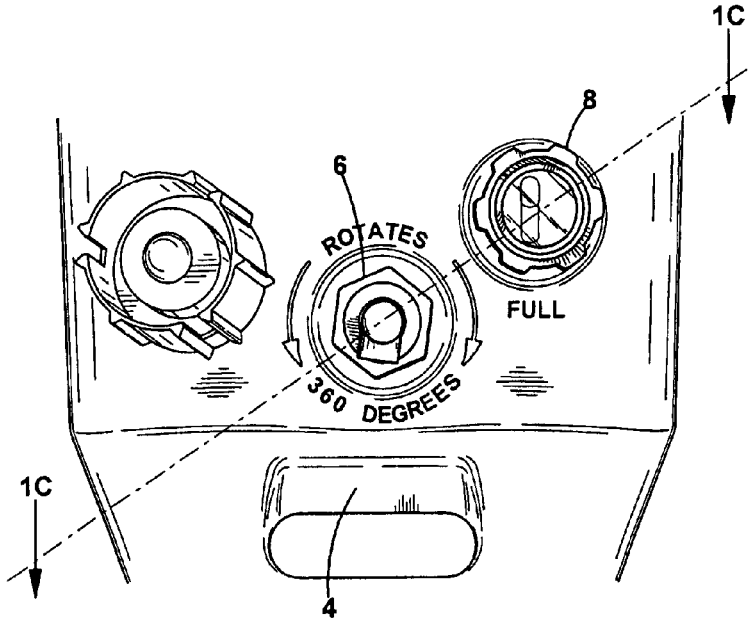
FIG. 1B is a top view of the invention demonstrating a fuel withdrawal assembly and direct-sight fuel gauge system mechanically fastened to the tank shell.
Figure 2:
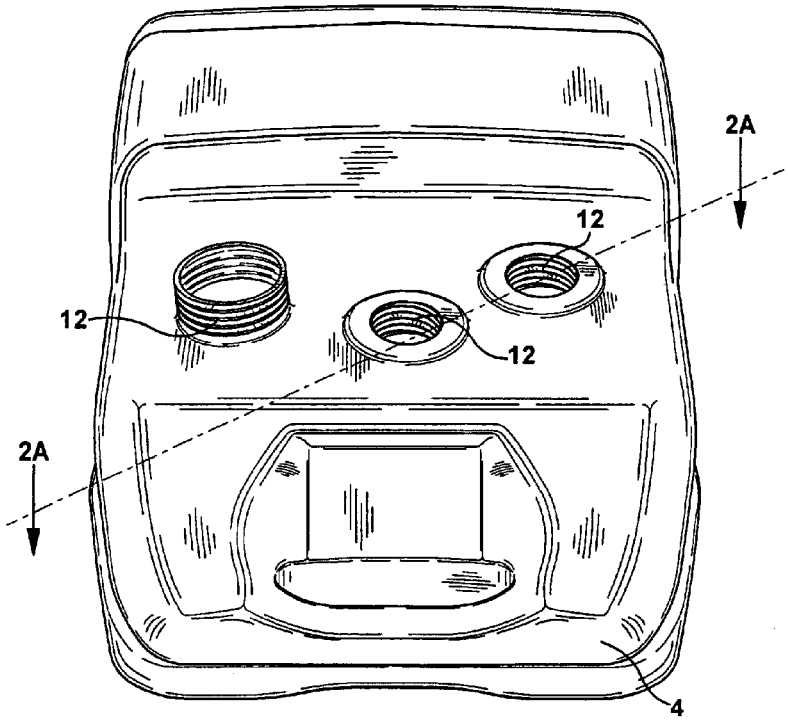
FIG. 2 is a perspective view of the invention with the fuel withdrawal assembly and direct-sight fuel gauge system removed.
Figure 2A:
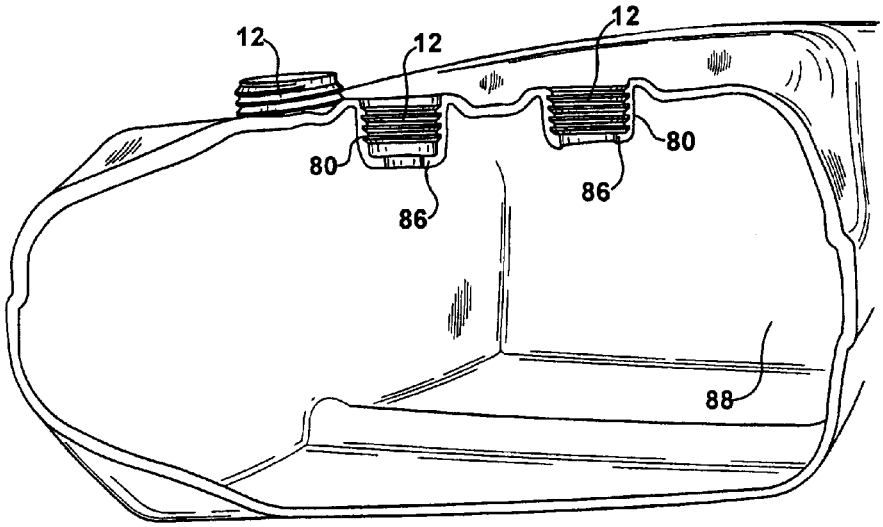
FIG. 2A is a cut-away view taken along the line 2A—2A in FIG. 2.
Figure 2B:
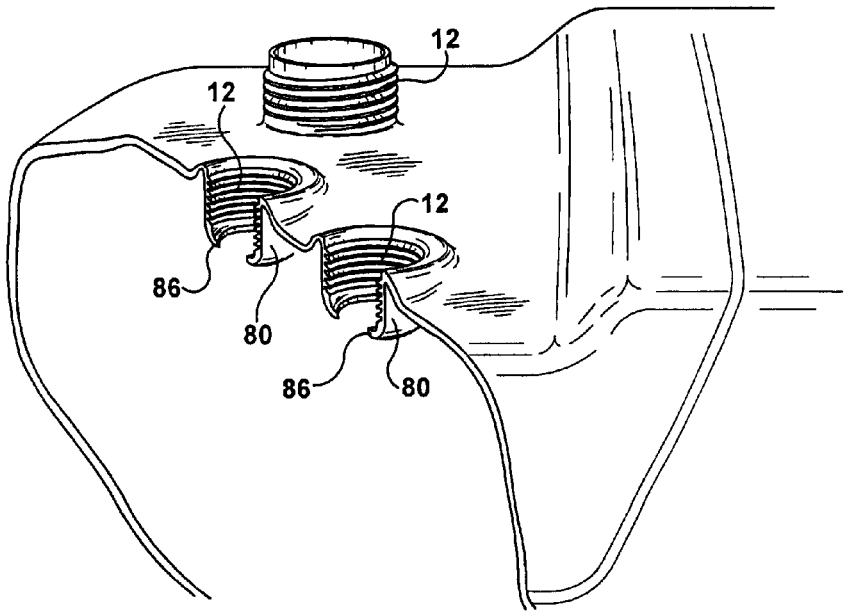
FIG. 2B is a perspective cut-away view of the device shown in FIG. 2A.
Figure 2C:
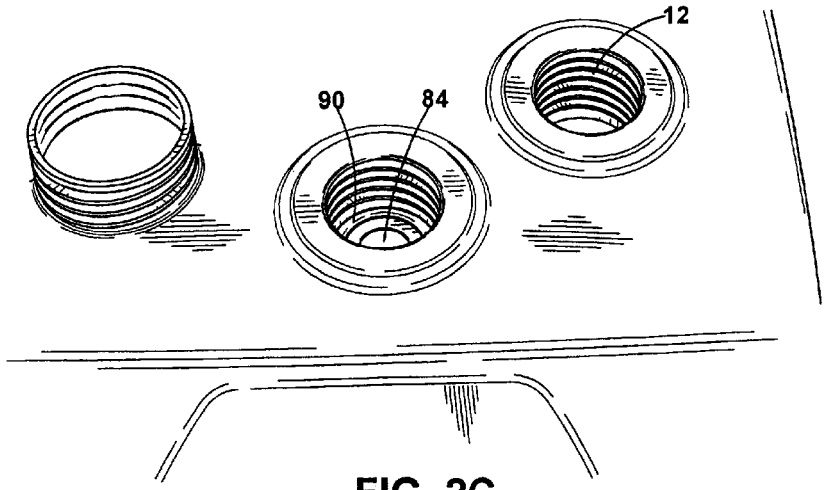
FIG. 2C is a close-up view of FIG. 2.
Figure 2D:
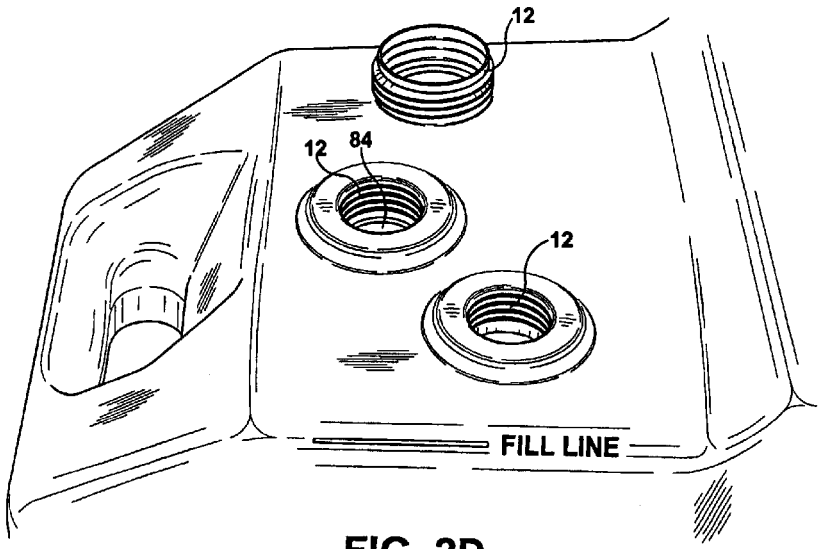
FIG. 2D is a perspective side view of the device as shown in FIG. 2.
Figure 3:
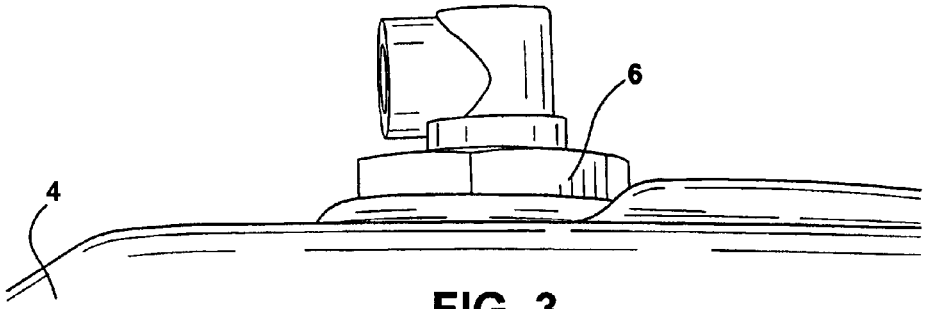
FIG. 3 is a side view of the fuel tank with the fuel withdrawal assembly.
Figure 3A:
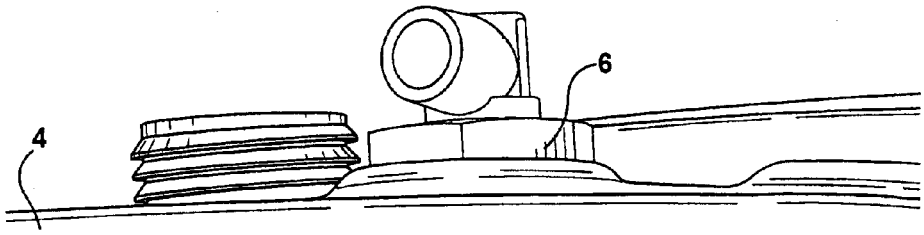
FIG. 3A is a perspective view of the fuel tank with the fuel withdrawal assembly.

The marine fuel tank 2 is shown in FIGS. 1–1F and 2–2D. In its preferred embodiment, the tank shell 4 is made of HDPE. The tank shell may be made of metal or any other material capable of being formed by any known method so long as the material is suitable for the purpose of holding gasoline or whatever substance the vessel is designed to contain. It is preferred that HDPE be blow molded into a seamless tank shell which defines an interior space 3*a*. FIG. 2 illustrates the threaded portions or threads 12 that are molded into the tank shell. In a preferred embodiment, at least one of the threaded bosses 80 of the fuel tank extend toward the interior of the tank shell (see FIGS. 2A–2D) so that the fuel withdrawal assembly has the shortest profile possible above the surface of the tank when they are fastened to the tank. For example, FIG. 3 illustrates the profile of a fuel withdrawal assembly 6 extending from the marine fuel tank 2. Because the actual fastening of this component occurs substantially in the interior space 3*a* of the tank, the fuel withdrawal assembly 6 stands about one to two inches from an outer surface 3*b* of the tank shell 4. It is not uncommon for prior art tanks to have fuel withdrawal outlets standing three inches above the surface of the tank. The closer a component sits in relation to the outer surface of a tank, the less likely that the component will be accidentally sheared from the tank.

In an alternative embodiment, the threaded portions 12 of the bosses 80 of the tank shell can extend away from the outer surface 3*b* of the tank shell 4. In this embodiment, the threads 12 may either be internal or external of the bosses, meaning that the components are complementary and are either screwed onto or screwed into the threads, respectively.

It is preferable that the threads 12 be buttress-style, as is depicted in, for example, FIGS. 7, 8, 11 and 15. It is also preferred that the threads be large sized or coarse as opposed to fine, as coarse threads are less apt to strip, especially where the tank shell is composed of HDPE. A seal at the tank shell/component interface with approximately one and one-half complete revolutions of sealing force applied. However, it is preferred that the seal formed between the tank shell and components be created by at least approximately three complete revolutions of sealing force. In addition to making the accidental loosening of components less likely, mechanically fastening a component to the tank shell with at least three revolutions of coarse, buttress-style interlocking threads greatly increases the contact surface area or seal formed at of the interface of the tank shell and the component(s). The greater the surface area between two parts at their interface, the less material creep becomes a factor in the potential for leakage occurring at that seal or interface. Because HDPE has a tendency to have a high material creep factor when stressed with a load or subjected to high temperatures (like those routinely experienced in the southern United States), reducing the effects of material creep is an important consideration in the manufacture of marine fuel tanks. Some prior art fuel tanks have solved the material creep problem by hot plate welding the components to the tank. While effective in reducing the effects of material creep, such tanks are considerably more expensive to produce than are the inventive fuel tanks disclosed herein. Moreover, the present invention has proven to be at least as effective as hot plate welded tanks in minimizing the effects of material creep. Insert molded tanks have not proven as successful as the present invention in reducing the effects of material creep, yet are still more expensive to produce.

Another advantage of the inventive fuel tank disclosed herein is that tanks with components mechanically fastened directly to their shells are less costly to produce than are the prior art fuel tanks. The mechanical fastening removes the need to chemically bond or weld the component to the tank shell. Therefore, the cost of the materials, labor and operation associated with bonding or adhering the component is eliminated. Moreover, the common practice in prior art tank manufacture is to bond an intermediary component between the tank shell and the functional tank component (such as the fuel withdrawal or direct-sight fuel gauge), meaning additional material, assembly and machining costs. In other words, the tank would be comprised of the tank shell, a part designed solely for the purpose of connecting the functional components to the tank shell, and the functional components themselves. Therefore, threading the tank shell so that the tank's functional components could be mechanically fastened directly to the shell not only saves the costs associated with bonding the component to the shell, but it also saves the costs associated with having to manufacture and bond additional and non-essential parts to the tank shell.

Figure 8:
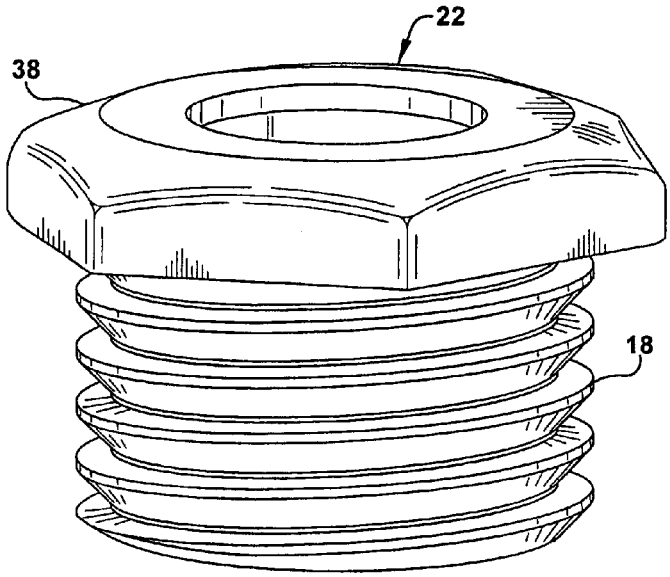
FIG. 8 is a perspective side view of the exterior of a mated fuel withdrawal split-nut housing.
Figure 9:
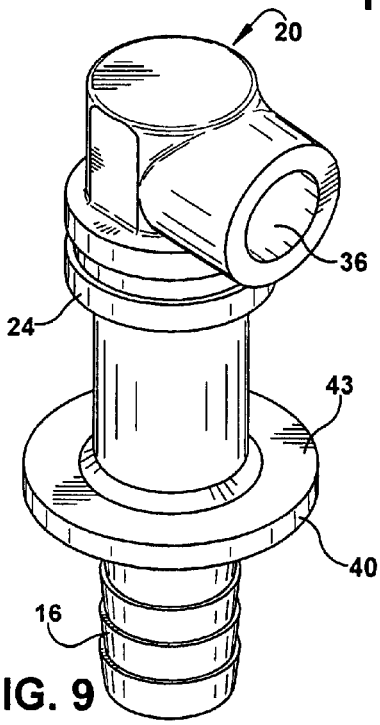
FIG. 9 is a perspective side view of the withdrawal outlet piece.
Figure 10:
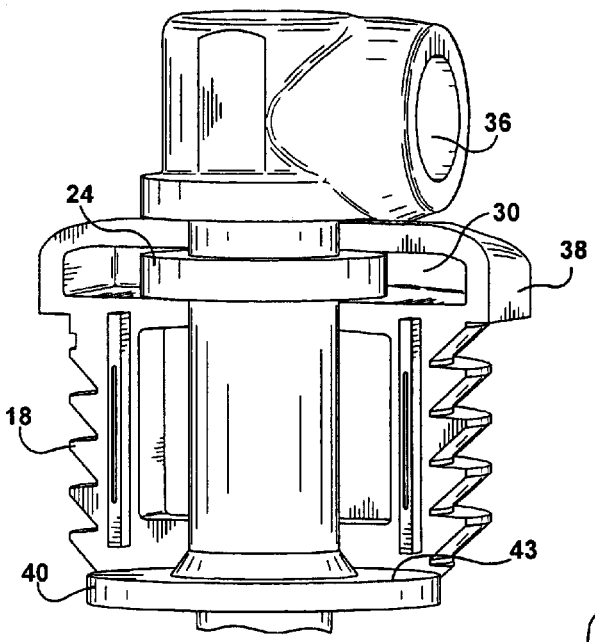
FIG. 10 is a perspective side view of the withdrawal outlet piece and the interior of half of the fuel withdrawal split nut housing.
Figure 11:
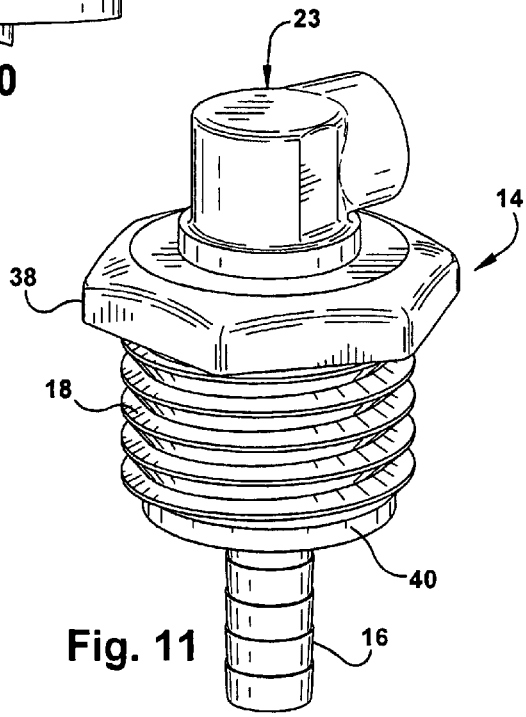
FIG. 11 is a perspective side view of the withdrawal outlet piece within a mated fuel withdrawal split-nut housing.
Figure 12:
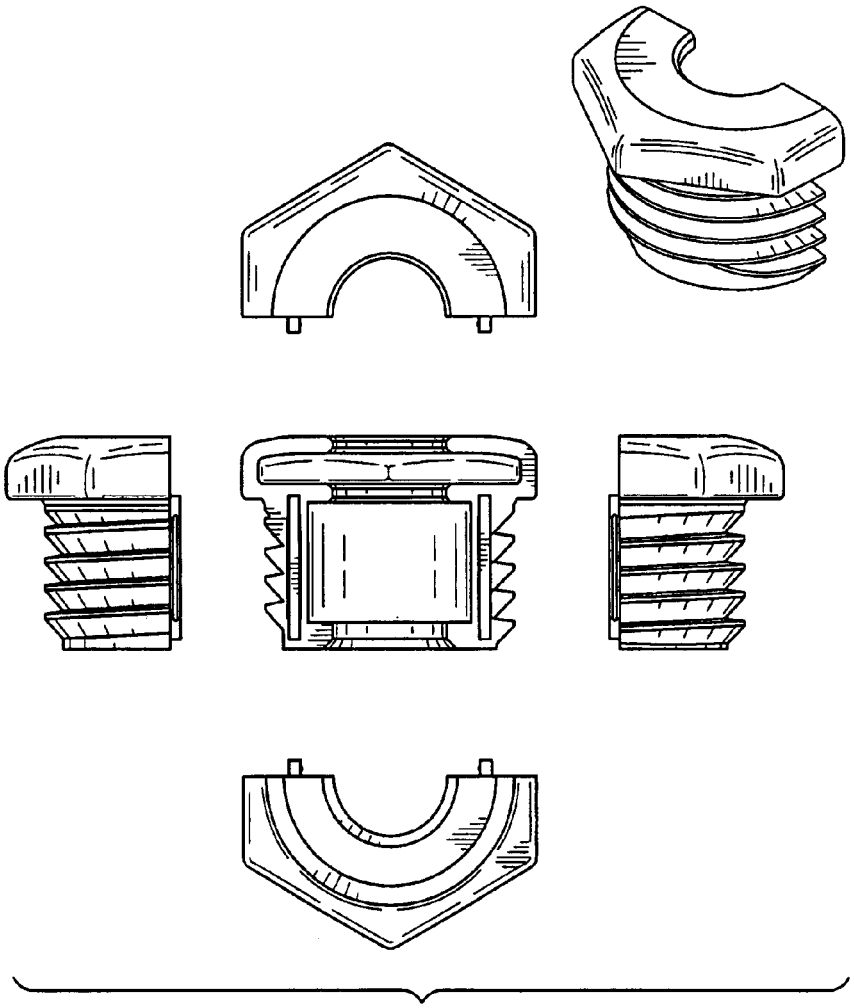
FIG. 12 schematically illustrates the male half of the fuel withdrawal split-nut housing.
Figure 13:
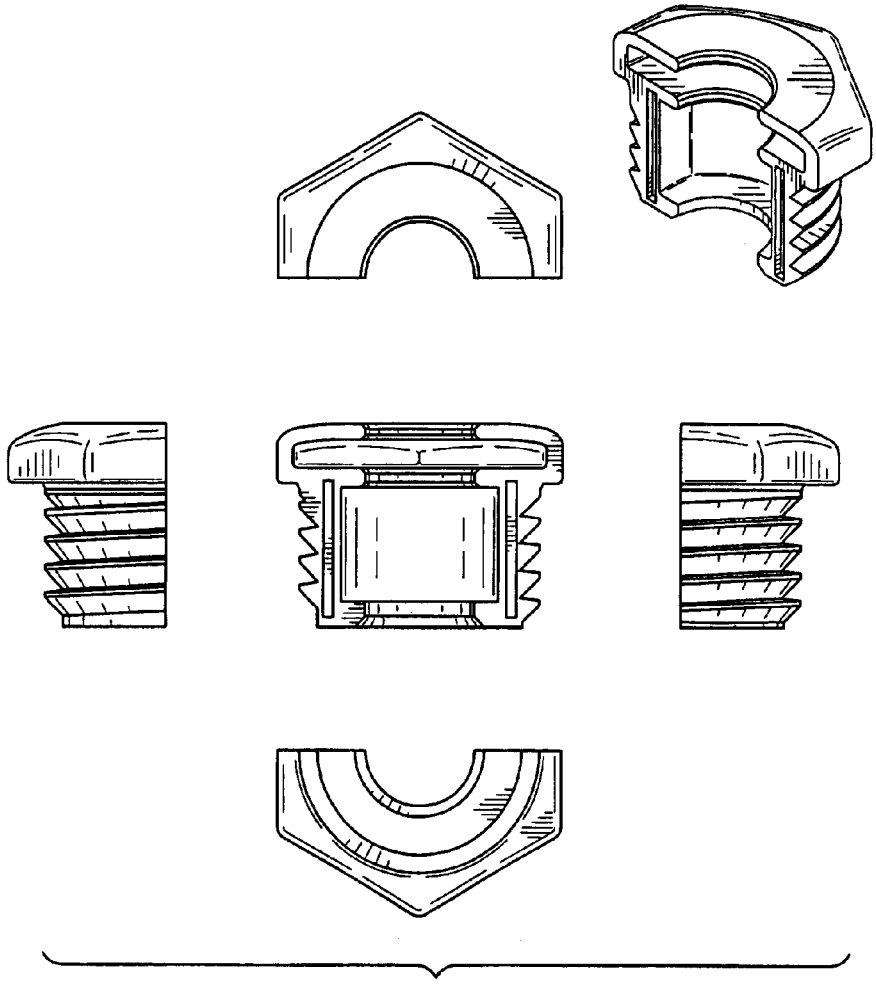
FIG. 13 schematically illustrates the female half of the fuel withdrawal split-nut housing.
Figure 14:
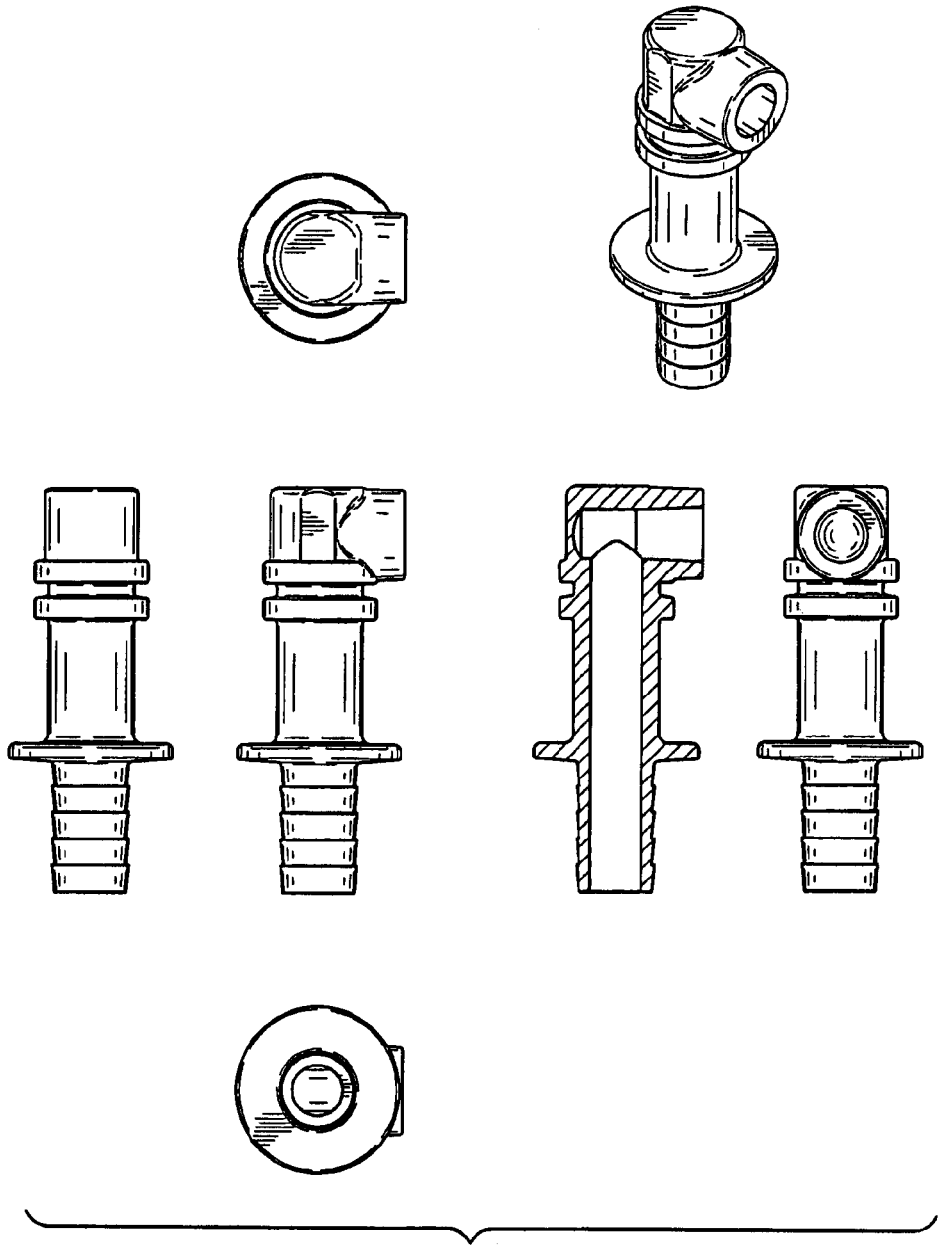
FIG. 14 schematically illustrates the withdrawal outlet piece.

The present invention may further comprise a marine fuel tank with a fuel withdrawal assembly or system that is capable of 360 degree rotation, allowing for the withdrawal outlet to be oriented linearly with the engine. FIGS. 1 and 3 illustrate a fuel withdrawal assembly 6 mechanically fastened to a tank shell 4. The rotation of a fuel withdrawal assembly located within a sealed system that is mechanically locked to the tank shell is made possible by the split-nut design of the fuel withdrawal system. FIG. 12 shows the combination withdrawal piece/split-nut assembly 23 that is screwed into the tank shell. FIG. 9 shows generally the withdrawal outlet piece 20. FIGS. 4–7 generally show the component halves of the split-nut. FIG. 8 shows the split-nut housing assembly 22 as it looks when its component halves are joined, forming a substantially continuous threaded portion with a head. FIG. 10 illustrates how the withdrawal outlet piece 20 is rotatably engaged within the interior of the split nut housing assembly 22.

Figure 4:
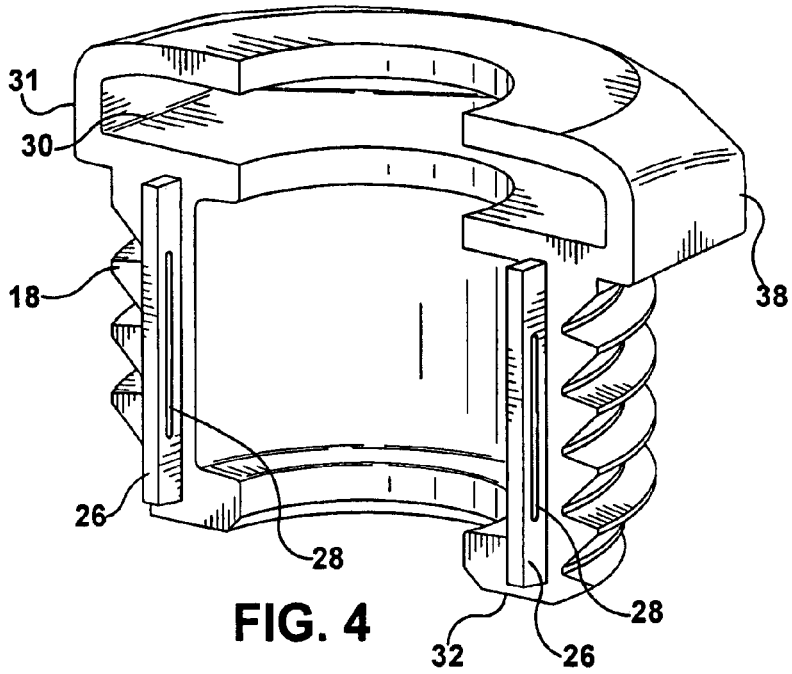
FIG. 4 is a perspective side view of the interior of the male half of the fuel withdrawal split-nut housing.
Figure 5:
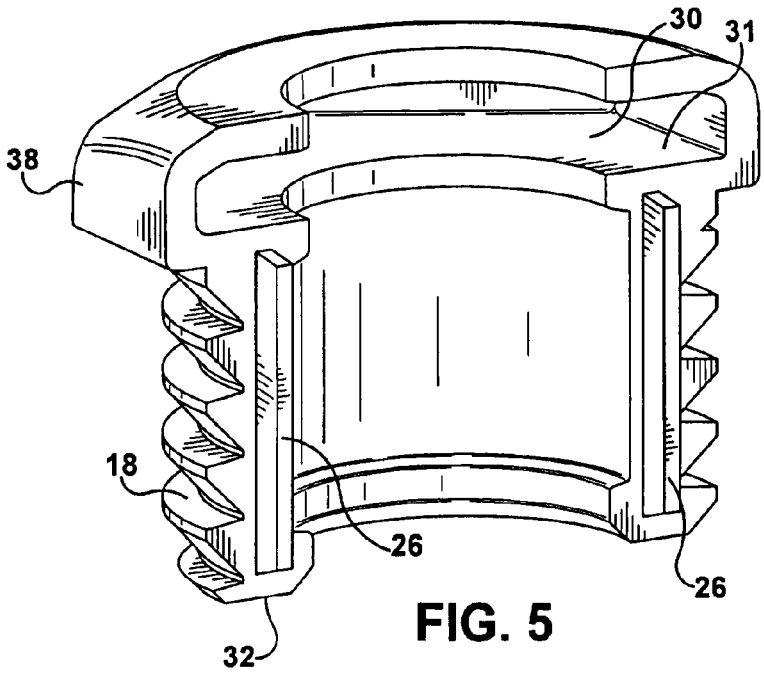
FIG. 5 is a perspective side view of the interior of another embodiment of the male half of the fuel withdrawal split-nut housing.
Figure 6:
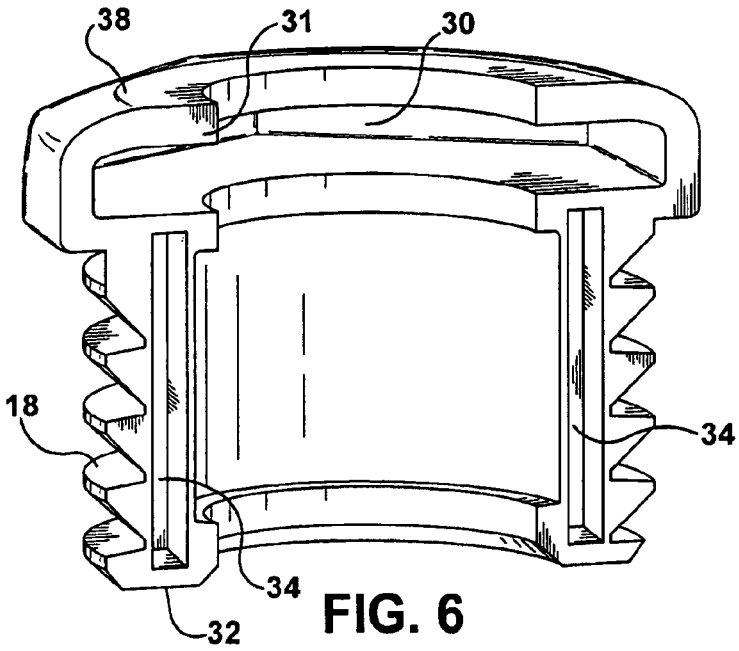
FIG. 6 is a perspective side view of the interior of the female half of the fuel withdrawal split-nut housing.
Figure 7:
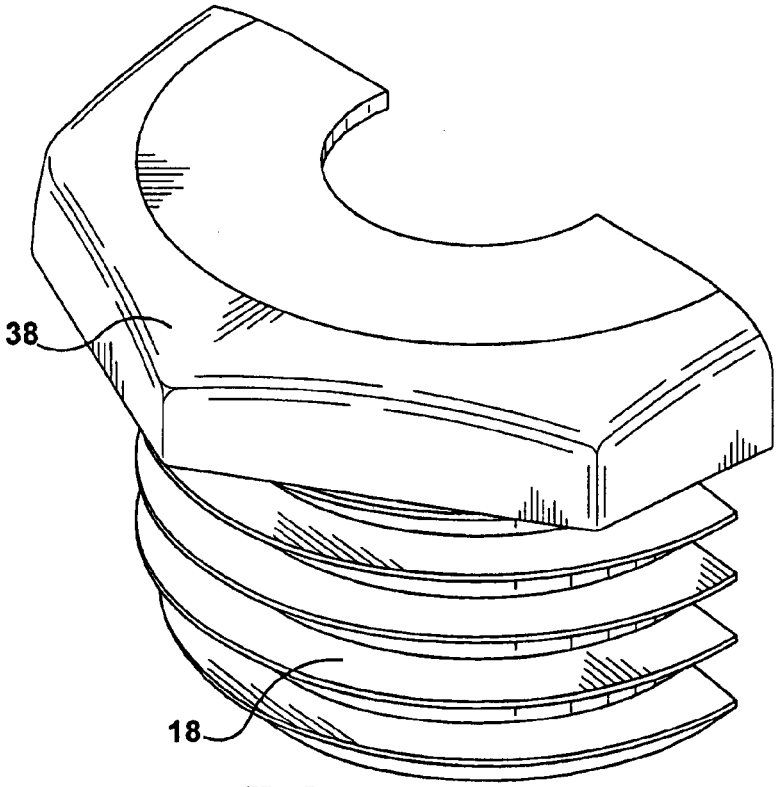
FIG. 7 is a perspective side view of the exterior of one half of the fuel withdrawal split-nut housing.

The split-nut housing assembly 22 is a substantially hollow device comprised of two mated or compatible halves which, with the exception of their mating parts, have otherwise identical interior dimensions. When mated, the two halves of the split-nut form a continuous threaded portion or a fastening device designed to accommodate a fuel withdrawal assembly within the interior space of the split-nut assembly. The exterior shape of the head 38 of the housing assembly 22 is shown as a hex-nut. The head may take any shape that allows the split-nut to be loosened or tightened by hand, wrench, adjustable wrench, pliers, channel locks, or other similar tools. The head 82 of the withdrawal outlet piece 20 preferably has two flats sides, so that the same tools may be used to rotate the outlet piece within the fastened split-nut. At least a portion of the exterior of the mated split-nut assembly will be substantially continuously threaded, the threaded portion or threads 18 being complimentary to the threaded portion or threads 12 of the tank shell 4. It is preferable that these threads be buttress-style. FIGS. 4 and 6 demonstrate how the halves of the split-nut assembly are mated. FIG. 4 depicts the male half of the split nut, having tabs 26. The embodiment of the male split-nut shown in FIG. 4 additionally illustrates ridges 28 that may be present on the tabs 26 to provide for a more secure mating to the female half of the split-nut. FIG. 6 depicts the female half of the split-nut. The female half has slots 34 into which the tabs 26 of the male half are inserted to fasten the mated halves together.

Figure 1C:
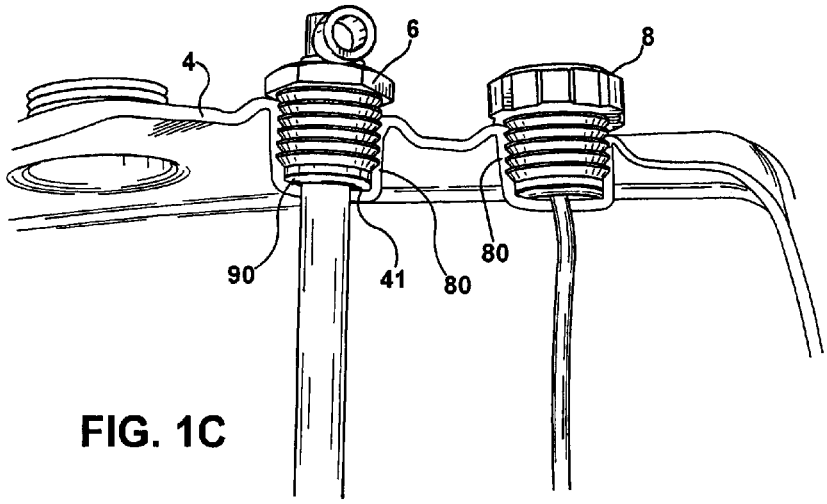
FIG. 1C is a partial cut-away view taken along the line 1C—1C in FIG. 1B.
Figure 1D:
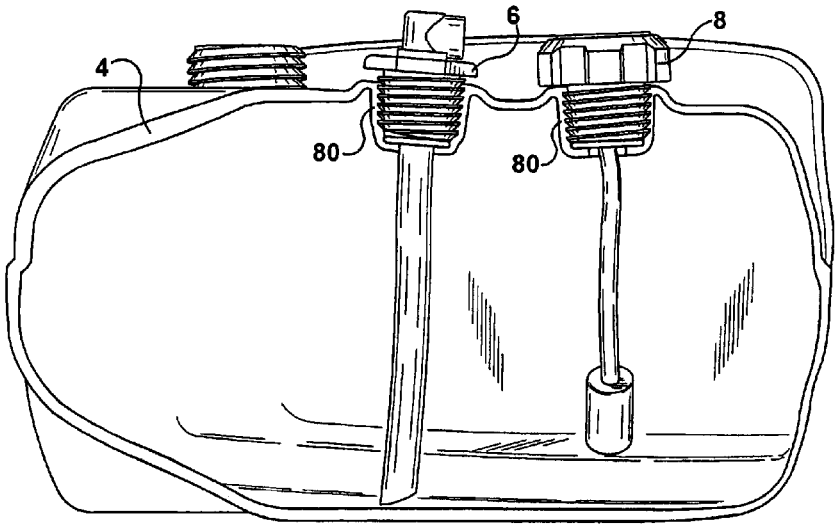
FIG. 1D is a cut-away view taken along the line 1C—1C in FIG. 1B.
Figure 1E:
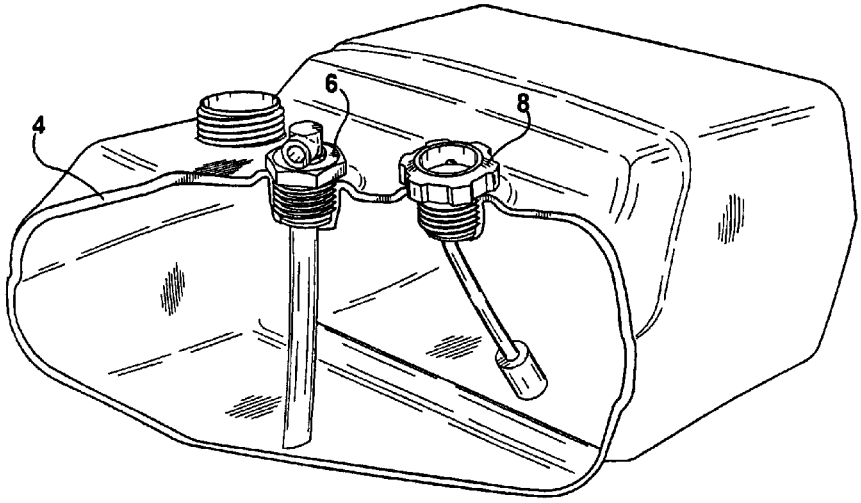
FIG. 1E is a perspective view of the device shown in FIG. 1D.
Figure 1F:
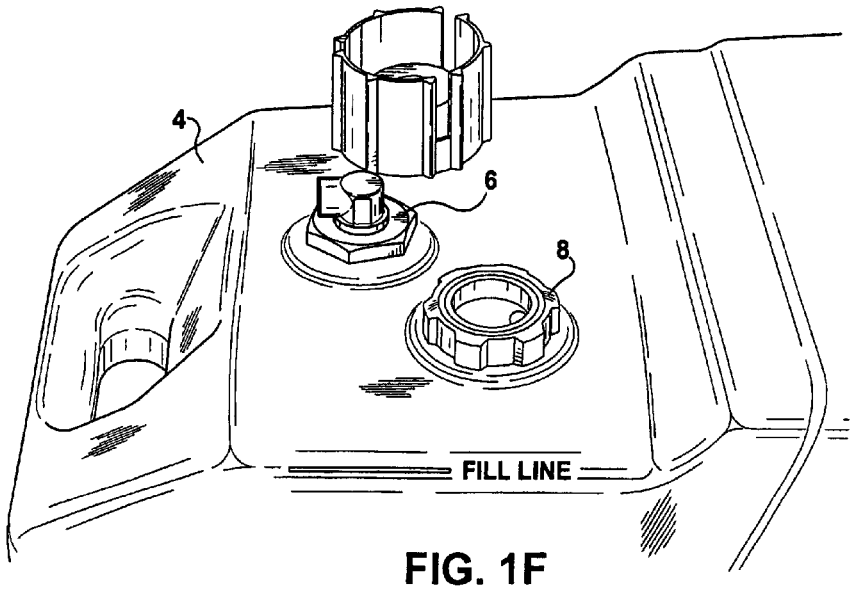
FIG. 1F is a perspective view of the invention demonstrating a fuel withdrawal assembly and direct-sight fuel gauge system mechanically fastened to the tank shell.

The withdrawal outlet piece 20 has an upper flange 24 around the top of the piece 20, near a withdrawal outlet opening 36. The upper flange 24 of the withdrawal outlet piece fits into the upper flange space 30 defined within an interior space of the head 38 of the split-nut housing assembly. When mated substantially surrounding the withdrawal piece 20, space 30 and the interior walls 31 of the split-nut head 38 help to prevent vertical movement of the outlet piece in the split-nut housing assembly. FIG. 10 illustrates how engagement of the withdrawal outlet piece 20 in the split-nut housing assembly resists horizontal movement of the outlet piece in the split-nut housing assembly. The fit is not so tight as to prohibit rotation of the outlet within the split-nut, however. The outlet piece has a lower flange 40 whose upper surface contacts 43 the lower exterior surface 32 of the split nut. Once engaged, the lower surface of the lower flange 40 forms a seal 41 between the fuel withdrawal assembly 6 and the tank shell where it interfaces or engages with the tank shell. The threaded boss of the tank shell can be described as being substantially capped or closed at one end, except for a hole of smaller diameter than the diameter of the threaded boss 80 of the tank shell 4. The threaded boss receives the split-nut assembly/withdrawal piece outlet combination, and a barbed or ridged portion 16 of the outlet extending below the lower flange passes through the hole 84 in capped end 86 of the threaded boss and into the interior space 3*a* of the tank. It is against this capped end 86 of the threaded boss 80 which the lower surface of the lower flange 40 forms the seal 41. Preferably, a gasket 90 is disposed in the capped end of the threaded boss 80 to facilitate the seal 41, as shown in FIG. 1C.

The fuel withdrawal assembly is preferably injection molded from 20% glass-filled polypropylene. The system can be made or formed from any material which could be formed, molded or machined to have the features as described herein. The split-nut as described herein has utility beyond fuel withdrawal systems for marine fuel tanks or other pressure vessels. The split-nut design could be used to secure any spool or rotating part that is required to be secured against horizontal and vertical movement within a mechanical system. For the purpose of this invention, "spool" shall mean any component designed to rotate about a single axis within a mechanical system, including fuel withdrawal outlet pieces. The interior of the split-nut can be customized to substantially surround any size or shape spool. Moreover, the exterior of the split-nut need not be circular or even threaded, but can be made to fit whatever shape the system dictates is necessary, and the connection of the split-nut to the mechanical system can be facilitated by press or snap fits or any number of other locking devices.

Figure 15:
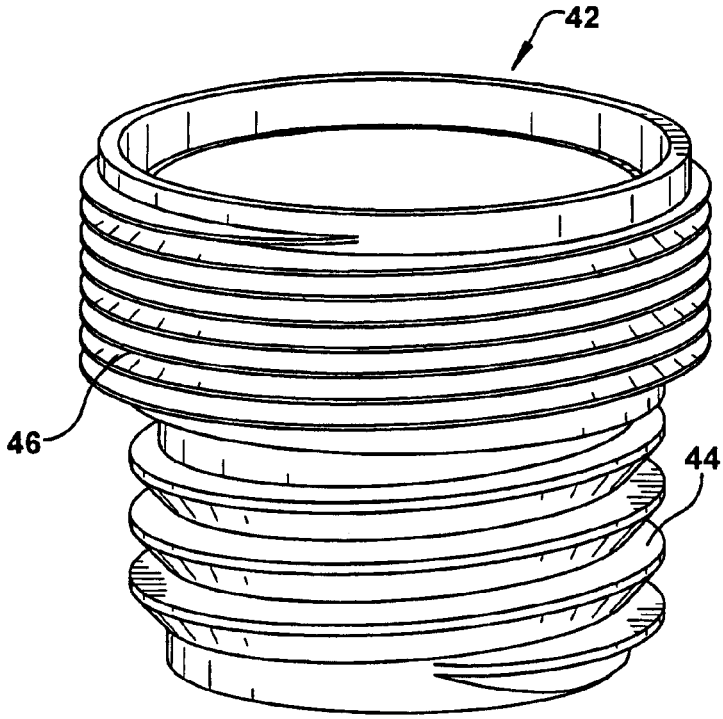
FIG. 15 is a perspective side view of the double-threaded gauge neck for the direct-sight fuel gauge system.
Figure 16:
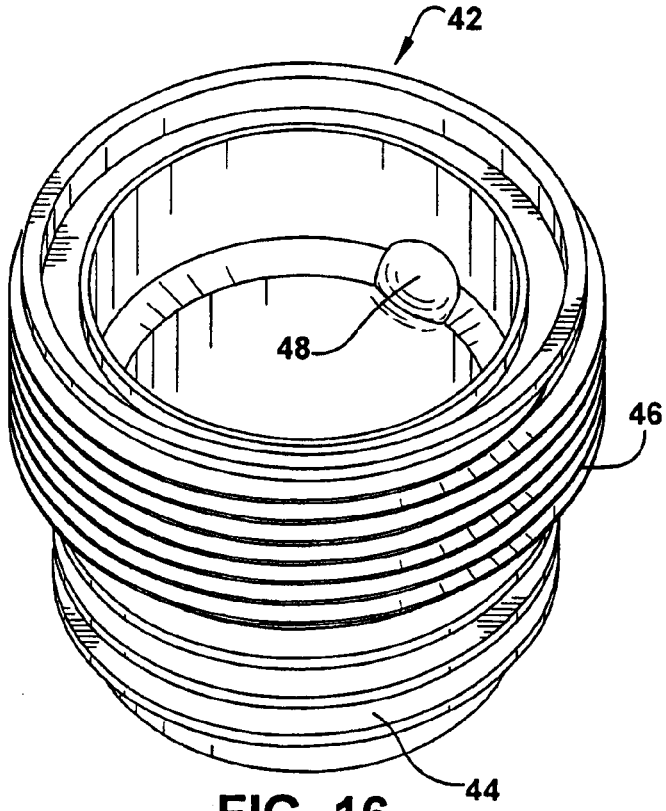
FIG. 16 is a perspective top view of the double-threaded gauge neck for the direct-sight fuel gauge system, showing one embodiment of the undercut or cradle which holds the fuel level indicating float arm.
Figure 17:
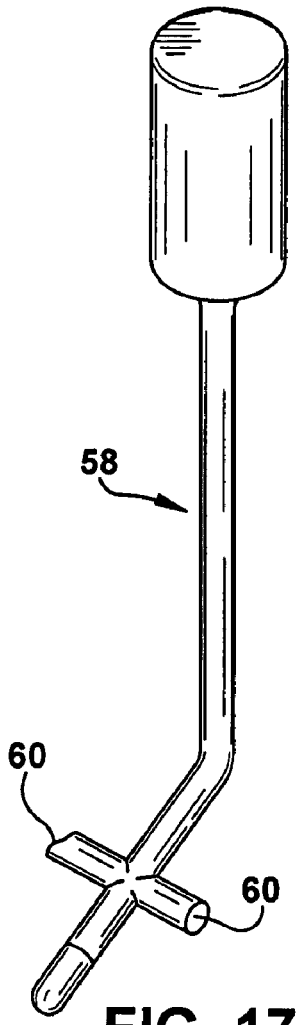
FIG. 17 is a perspective side view of the float arm.
Figure 17A:
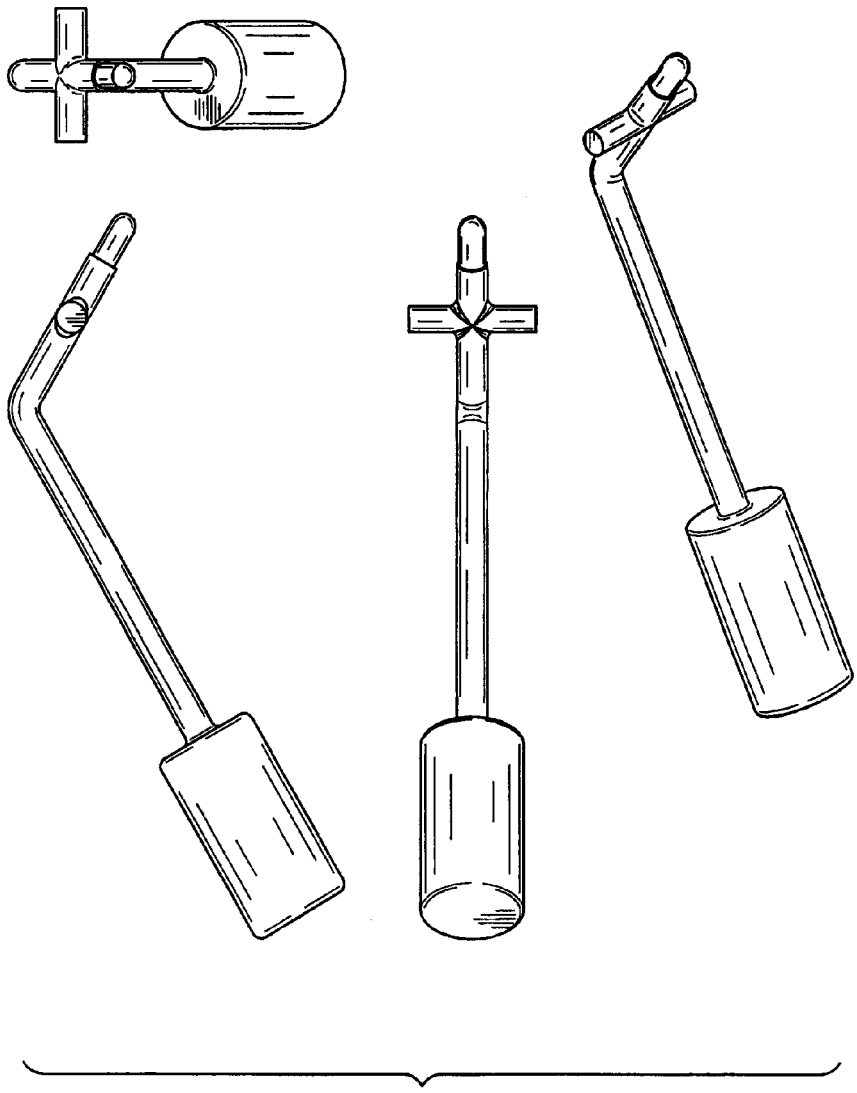
FIG. 17A schematically illustrates the float arm of FIG. 17.
Figure 18:
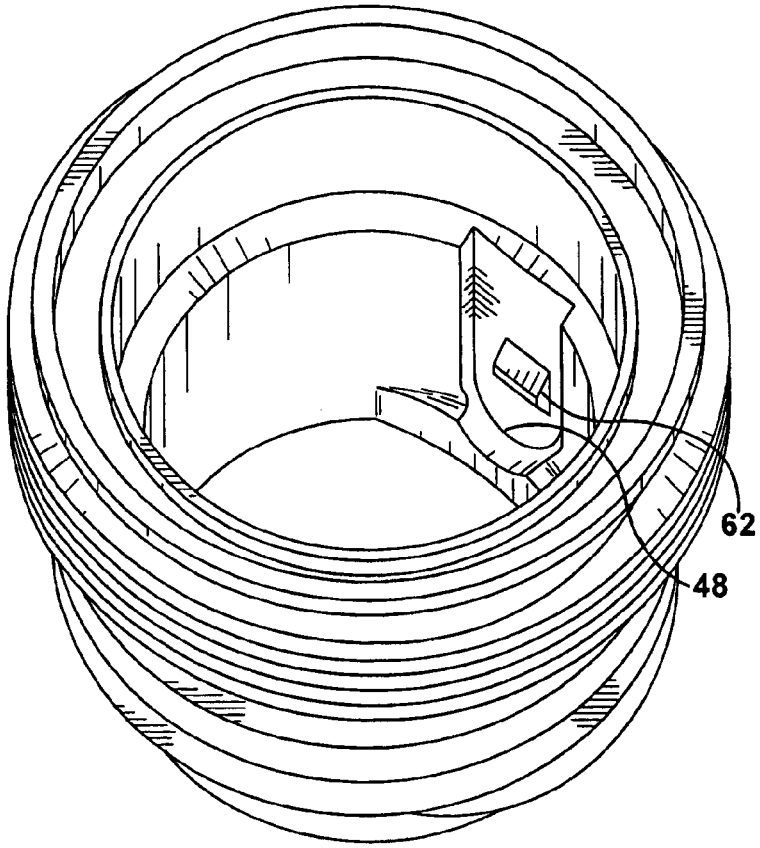
FIG. 18 is a perspective top view of the interior of another embodiment of the interior of the gauge neck and undercut.
Figure 18A:
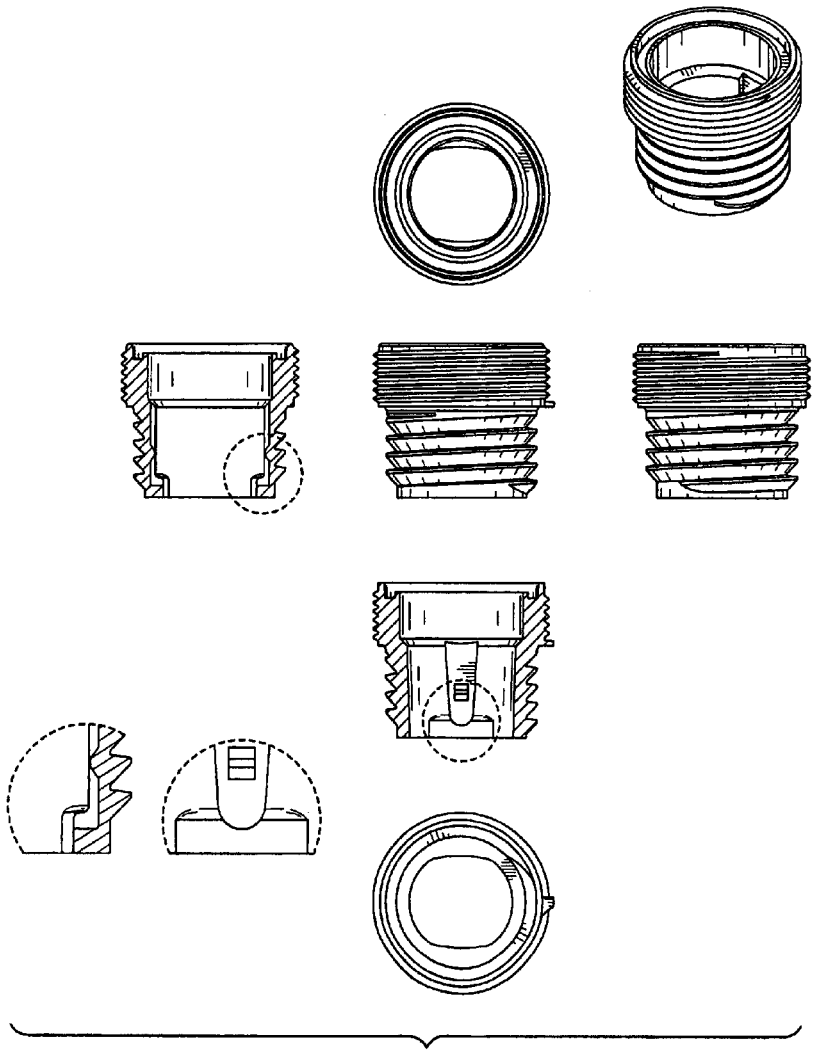
FIG. 18A schematically illustrates the embodiment of the gauge neck depicted in FIG. 18.
Figure 18B:
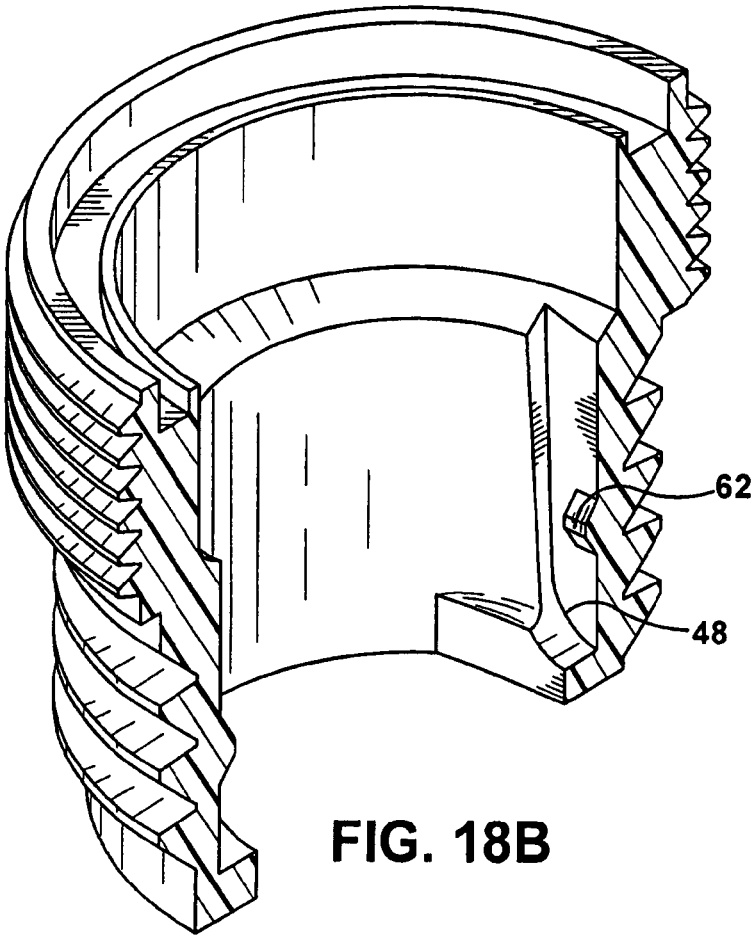
FIG. 18B is a perspective top view of a cut-out of the interior of the embodiment of the gauge neck depicted in FIG. 18.
Figure 19:
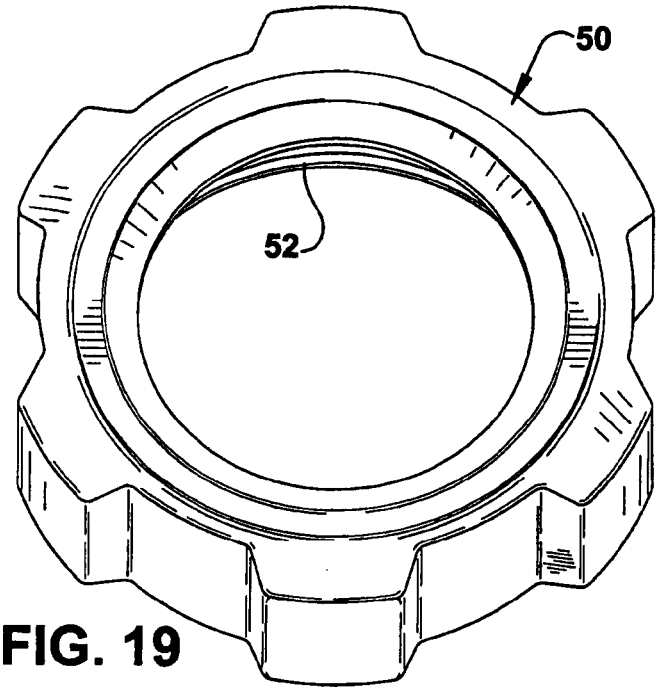
FIG. 19 is a perspective top view of the cap for the direct-sight fuel gauge system.
Figure 20:
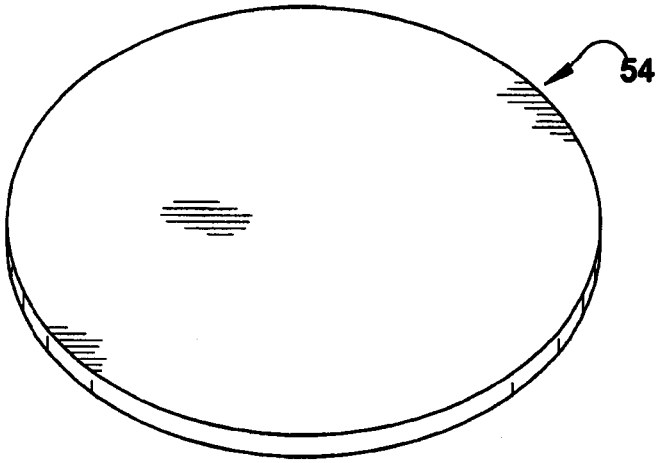
FIG. 20 is a perspective top view of the lens for the direct-sight fuel gauge system.
Figure 21:
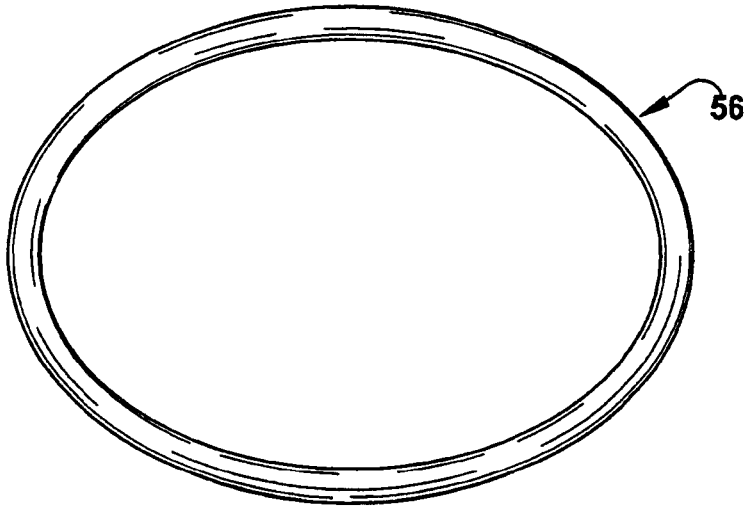
FIG. 21 is a perspective top view of the o-ring for the direct-sight fuel gauge system.
Figure 22:
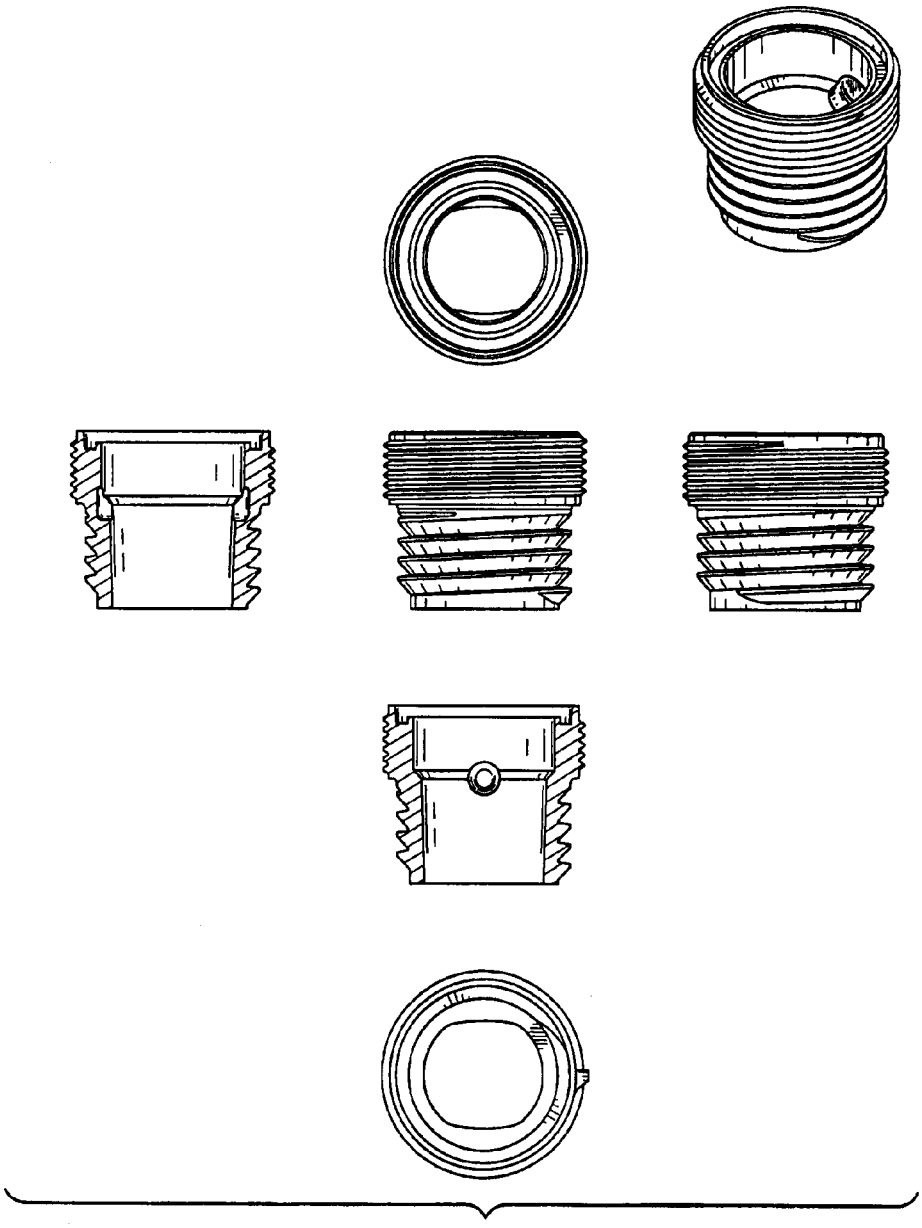
FIG. 22 schematically illustrates the double-threaded gauge neck for the direct-sight fuel gauge system.
Figure 23:
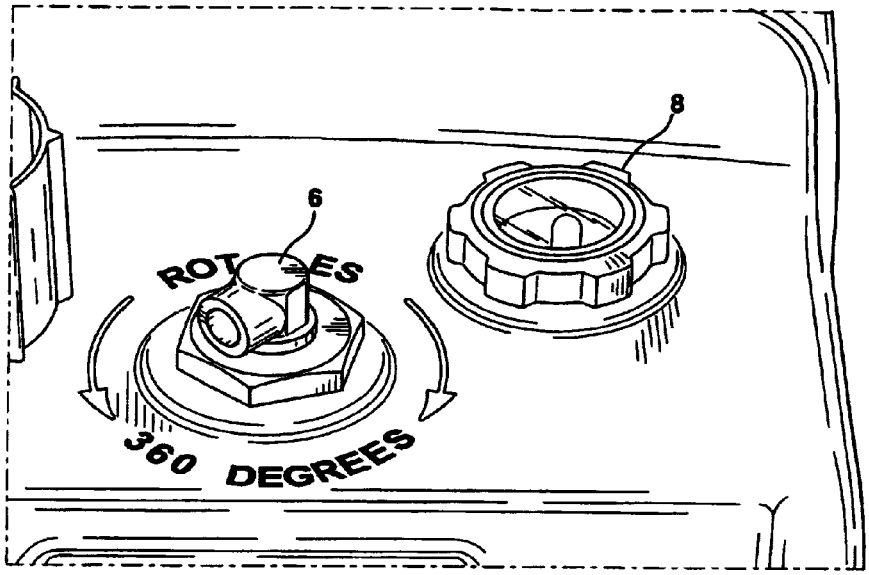
FIGS. 23 and 23A are perspective top views of the fuel withdrawal assembly fastened to the tank shell, and schematically illustrating the ability of the fuel withdrawal outlet to rotate.
Figure 23A:
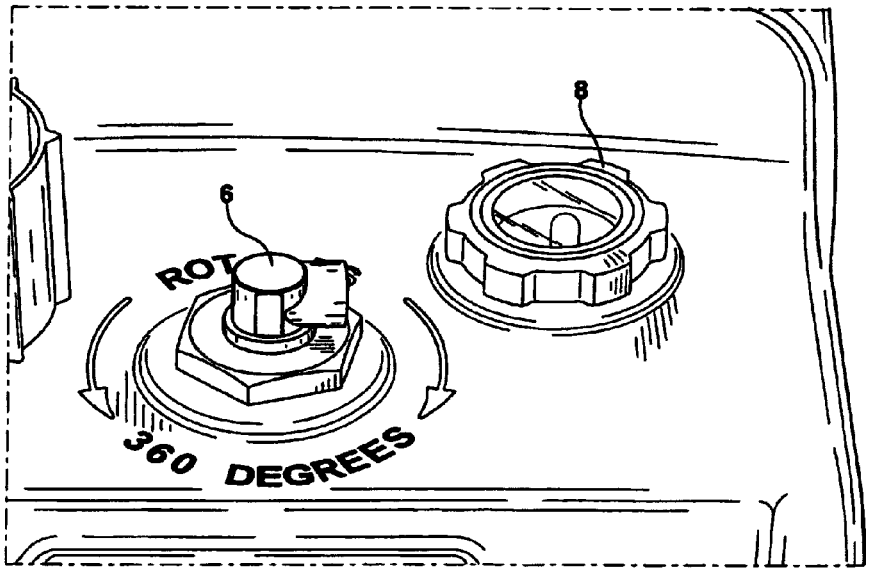

The present invention may also include an improved direct-sight fuel gauge system 8 mechanically attached to the tank shell as described above. FIG. 1 illustrates a marine fuel tank 2 with a direct-sight fuel gauge attached mechanically attached to the tank shell. FIG. 2 illustrates the design of the tank shell accommodating the mechanical connection of the fuel gauge system 8. A double-threaded gauge neck 42 as depicted in FIG. 15 is first screwed into the tank shell. The lower threads 44 are compatible with the tank shell threads 12. The upper threads 46 of the gauge neck are compatible with the threads 52 of the gauge cap 50 as illustrated in FIG. 19. The cap secures an o-ring 56 and a lens 54. FIG. 16 depicts one embodiment of the undercut or cradle 48 in the interior wall of the gauge into which the float arm 58 connects. The preferred embodiment of the undercut is shown in FIGS. 18–18B. The cross-bars 60 of the float arm 58 snap into engagement with the undercut 48, and are secured in place by tabs 62. The locking tab 62 as shown in FIGS. 18–18B represents an undercut in line of tooling draw during the injection molding process. To mold this component, an injection mold tool has been designed to come in from the opposite tool side with a blade. This blade forms the bottom of the undercut design, so the tool opens in line of draw and does not have to jump over a tab. The line of tooling draw is clear. While accomplishing the locking tab undercut, the float arm cradle is interrupted with a voided space for the float cross bar to pivot on. If a larger blade is used for the tab bottom, the end result is a loss of surface contact for a pivot point. Should a thinner tool blade be used than the injection molding, tool pressure will bend the blade.

The undercut 48 in the gauge neck allows the float arm to be inserted into the direct-sight gauge without requiring additional components to secure it in place. The advantages of eliminating components from the marine fuel tank have been discussed above. The float arm 58 itself is comprised of only one component, and it is preferably formed via injection molding. Prior art float arms required assembly of multiple components. Again, this improved direct view fuel gauge system enjoys the advantage of efficient and effective function while reducing components from the product.

While certain representative embodiments and details have been shown for the purpose of illustrating the invention, it will be apparent to those skilled in the art that various changes and modifications may be made therein without departing from the spirit or scope of the invention.

We claim:

1. A pressure vessel comprising:

a seamless tank shell defining an interior space and having an outer surface wherein said tank shell is comprised of more than one boss, each of said bosses having a threaded portion; said outer surface having a fuel withdrawal assembly or a direct-sight fuel gauge mechanically fastened thereto; and said fuel withdrawal assembly includes a treaded portion engaged with said threaded portion of one of said plurality of bosses; and said fuel withdrawal assembly is engaged with said one of said plurality of bosses by one and one-half revolutions of sealing force; and said fuel withdrawal assembly includes a withdrawal outlet piece capable of 360 degree rotation when engaged with said fuel withdrawal assembly; and said one of said bosses which is engaged with said fuel withdrawal assembly is substantially engaged with said interior space of said tank shell and said fuel withdrawal assembly extends less than 1.5 inches above said outer surface of said tank shell; and the fuel withdrawal assembly comprises a split-nut housing including two mated halves, said mated halves defining an interior space and forming a continuous threaded portion, and, said withdrawal outlet piece rotatably engaged within said interior space defined by said mated halves; and said one of said plurality of bosses to which the fuel withdrawal assembly is connected is comprised of a substantially capped end, the fuel withdrawal assembly is comprised of a lower flange having a lower surface, and the lower surface engages the capped end to form a seal;

the direct-sight fuel gauge having a threaded portion engaged with said threaded portion of one of said plurality of bosses; and the direct-sight fuel gauge comprises:

a gauge neck having a lower portion having threads, an upper portion having threads, and an interior wall having a gauge cap having threads wherein the lower portion of the gauge neck is threadedly connected to said one of said plurality of bosses, the gauge cap is threadedly connected to said upper portion of the gauge neck.

2. The pressure vessel of claim 1, wherein said interior wall of said gauge neck has two cradles and a plurality of tabs; a float arm having cross-bars; and said cross-bars of said float arm are engaged with said cradles and said plurality of tabs secure the cross-bars with the cradles.

3. The pressure vessel of claim 1 wherein the tank shell is comprised of high-density polyethylene.

4. The pressure vessel of claim 3 wherein the split-nut housing of the fuel withdrawal assembly is substantially comprised of 20% glass-filled polypropylene.

5. The pressure vessel of claim 4 wherein the threads of said plurality of bosses are buttress-style threads.

6. A portable fuel storage tank comprising:

a seamless tank shell defining an interior space and having an outer surface wherein said tank shell is comprised of more than one boss, each of said bosses having a threaded portion; said outer surface having a fuel withdrawal assembly or a direct-sight fuel gauge mechanically fastened thereto; and said fuel withdrawal assembly includes a threaded portion engaged with said threaded portion of one of said plurality of bosses; and said fuel withdrawal assembly is engaged with said one of said plurality of bosses by one and one-half revolutions of sealing force; and said fuel withdrawal assembly includes a withdrawal outlet piece capable of 360 degree rotation when engaged with said fuel withdrawal assembly; and said one of said bosses which is engaged with said fuel withdrawal assembly is substantially engaged with said interior space of said tank shell and said fuel withdrawal assembly extends less than 1.5 inches above said outer surface of said tank shell; and the fuel withdrawal assembly comprises a split-nut housing including two mated halves, said mated halves defining an interior space and forming a continuous threaded portion, and, said withdrawal outlet piece rotatably engaged within said interior space defined by said mated halves; and said one of said plurality of bosses to which the fuel withdrawal assembly is connected is comprised of a substantially capped end, the fuel withdrawal assembly is comprised of a lower flange having a lower surface, and the lower surface engages the capped end to form a seal;

the direct-sight fuel gauge having a threaded portion engaged with said threaded portion of one of said plurality of bosses; and the direct-sight fuel gauge comprises:

a gauge neck having a lower portion having threads, an upper portion having threads, and an interior wall having a gauge cap having threads wherein the lower portion of the gauge neck is threadedly connected to said one of said plurality of bosses, the gauge cap is threadedly connected to said upper portion of the gauge neck.

7. The portable fuel storage tank of claim 6, wherein said interior wall of said gauge neck has two cradles and a plurality of tabs; a float arm having cross-bars; and said cross-bars of said float arm are engaged with said cradles and said plurality of tabs secure the cross-bars with the cradles.

8. The portable fuel storage tank of claim 6 wherein the tank shell is comprised of high-density polyethylene.

9. The portable fuel storage tank of claim 7 wherein the split-nut housing of the fuel withdrawal assembly is substantially comprised of 20% glass-filled polypropylene.

10. The portable fuel storage tank of claim 9 wherein the threads of said plurality of bosses are buttress-style threads.

* * * * *